US011974656B2

(12) United States Patent
Mui

(10) Patent No.: US 11,974,656 B2
(45) Date of Patent: May 7, 2024

(54) APPARATUS AND METHOD FOR CARRYING AND STORING FOOTWEAR

(71) Applicant: Lok Yee Mui, Boston, MA (US)

(72) Inventor: Lok Yee Mui, Boston, MA (US)

( * ) Notice: Subject to any disclaimer, the term of this patent is extended or adjusted under 35 U.S.C. 154(b) by 0 days.

(21) Appl. No.: 17/571,974

(22) Filed: Jan. 10, 2022

(65) Prior Publication Data

US 2022/0218092 A1 Jul. 14, 2022

Related U.S. Application Data

(60) Provisional application No. 63/135,728, filed on Jan. 10, 2021.

(51) Int. Cl.
*A45F 3/14* (2006.01)

(52) U.S. Cl.
CPC ..... *A45F 3/14* (2013.01); *A45F 2200/05* (2013.01)

(58) Field of Classification Search
CPC ..... A45F 3/14; A45F 2200/05
See application file for complete search history.

(56) References Cited

U.S. PATENT DOCUMENTS 2,428,074 A * 9/1947 Hanson ..... A45F 5/00 224/250
2,679,937 A * 6/1954 Fulster ..... A47L 23/20 294/159
3,003,727 A * 10/1961 Medor ..... A61J 9/0692 248/104
3,587,951 A * 6/1971 Derouin ..... A43B 5/0425 294/166
3,865,339 A * 2/1975 Von Alven ..... A61M 5/1417 248/318
3,931,948 A * 1/1976 Mason, Jr. ..... A47G 7/047 248/318
4,244,498 A * 1/1981 Copp ..... A43B 5/0425 D9/438
4,629,103 A * 12/1986 Miller ..... A63C 11/023 294/162
4,790,462 A * 12/1988 Kawaguchi ..... A43B 5/0425 224/616
4,815,642 A * 3/1989 Ray ..... A43B 5/0425 224/220

(Continued)

FOREIGN PATENT DOCUMENTS

JP 2551256 B2 11/1996

*Primary Examiner* — Scott T McNurlen
*Assistant Examiner* — Lester L Vanterpool
(74) *Attorney, Agent, or Firm* — Caldwell Intellectual Property Law

(57) ABSTRACT

A system for carrying food apparel having device made of a continuous strip of material forming two or more loops and an interlocking member that when moved chases the diameter of the loops. The device contracts around shoes at various points including the mid sole region or the heels. The device is attachable to, for example, a travel bag, wrist-band, or shoulder band. The device may be attachable through, for example, a magnet, hook, button, velcro, zippers, clips or carabiner. In addition disclosed is a method of carrying foot apparel involving providing the device, placing a foot apparel into each loop of the device, tightening the loops, and attaching the loops to the exterior of a bag, hand strap, wrist strap, or shoulder strap.

18 Claims, 8 Drawing Sheets

(56) References Cited

U.S. PATENT DOCUMENTS 4,867,359 A * 9/1989 Donovan ..... A63C 11/023 224/264
5,282,553 A 2/1994 Ibled
5,285,939 A 2/1994 Hogan
5,425,485 A * 6/1995 Carlo ..... A45F 3/14 24/298
5,511,754 A * 4/1996 Johannsen ..... A47G 23/0225 248/315
5,513,787 A * 5/1996 Reed ..... A63C 11/023 224/602
5,582,337 A 12/1996 McPherson et al.
D387,396 S * 12/1997 Chao ..... D21/453
5,746,685 A * 5/1998 Glaser ..... A63B 21/4021 2/161.1
5,779,036 A 7/1998 Westbrook et al.
5,908,206 A * 6/1999 LoPresti, Jr. ..... A63C 11/023 224/220
D413,078 S * 8/1999 Hanson ..... D11/131
6,446,849 B1 * 9/2002 Schleifer ..... A45F 3/14 294/149
7,662,073 B1 * 2/2010 Baldwin ..... A63B 21/4001 482/92
8,393,016 B2 * 3/2013 Wilkins-Gaudio ..... A41F 9/002 2/338
8,505,755 B2 * 8/2013 Greenberg ..... A47G 19/2222 215/229
9,770,086 B2 * 9/2017 Prisco ..... A45F 3/14
D826,560 S * 8/2018 Prisco ..... D3/317
D826,561 S * 8/2018 Prisco ..... D3/317
D826,562 S * 8/2018 Prisco ..... D3/317
D826,563 S * 8/2018 Prisco ..... D3/317
D826,564 S * 8/2018 Prisco ..... D3/317
D840,154 S * 2/2019 Prisco ..... D3/317
10,244,853 B2 * 4/2019 Friedberg ..... A45F 5/10
11,089,851 B2 * 8/2021 Leaks, Jr. ..... A45C 3/12
11,229,277 B1 * 1/2022 Davies ..... A63B 21/169
2005/0194803 A1 * 9/2005 Perry ..... A45F 3/14 294/145
2007/0033713 A1 * 2/2007 Carreon ..... A45C 13/30 2/327
2007/0039841 A1 * 2/2007 Deloatch-Ratliff ..... A45C 3/12 206/278
2007/0272570 A1 * 11/2007 Brooks ..... A45C 11/00 206/315.9
2011/0101052 A1 * 5/2011 Armstrong ..... A45C 13/30 224/254
2011/0204107 A1 * 8/2011 LeMert ..... A45F 3/14 224/250
2012/0210600 A1 * 8/2012 Joubert ..... A43C 15/10 36/7.1 R
2016/0338473 A1 * 11/2016 Clews ..... A45C 13/30
2017/0164721 A1 * 6/2017 Forney ..... A45F 3/14
2017/0172287 A1 * 6/2017 Prisco ..... A45F 3/04
2018/0310696 A1 * 11/2018 Getter ..... A45F 3/14
2019/0246774 A1 * 8/2019 Becht ..... A45F 3/00

* cited by examiner

APPARATUS AND METHOD FOR CARRYING AND STORING FOOTWEAR

CROSS REFERENCE TO RELATED APPLICATIONS

This application claims priority from U.S. Provisional Patent Application No. 63/135,728 filed on Jan. 10, 2021 entitled Apparatus and method for footwear carrying and storing, which is hereby incorporated by reference.

BACKGROUND OF THE INVENTION

Field of the Disclosed Subject Matter

The disclosed subject matter relates to a, convenient, and effective apparatus and method for carrying and storing footwear. Particularly, the present disclosed subject matter is directed to a device for carrying and storing various items including shoes.

Description of Related Art

Often times, women bring an extra pair of flats to change while in heels, and vice versa, during commute. Occasions include but not limited to wedding events, clubbing, conferences, or going to work. However, the process of carrying is bothersome. We may run out of space to carry them, it can get cumbersome, we may lose them, or the plastic bags we use to carry the shoes are unpresentable. On the other hand, it was found that men also have their hectic issues in carrying dress shoes during travelling or communing.

There thus remains a need for, convenient, and effective apparatus and method for carrying and storing footwear, in particular a device for carrying and storing various items including shoes.

BRIEF SUMMARY OF THE DISCLOSURE

The purpose and advantages of the disclosed subject matter will be set forth in the description below. Additional advantages of the disclosed subject matter will be realized by the specific embodiments disclosed in the written description, claims and included drawings.

To achieve these advantages as well as others relating to the purpose of the disclosed subject matter as embodied and described, the disclosed subject matter includes convenient, and effective apparatus and method for carrying and storing footwear, in particular a device for carrying and storing various items including shoes.

The invention is a gadget that can hold shoes. This invention works by strapping around the shoes, through a strip of material or an opening within the materials. The grasp location can be at mid sole region, the heels or a number of supporting points along the shoes.

Another embodiment of this invention is that it is conjunct and can be attached to bags, wrist band and shoulder band. The method to attach can be but not limited to magnet, hook, button, velcro, zippers, clips or carabiner. This makes the carrying process accessible and alleviates space constraint inside the bag.

Another embodiment of this invention is that the gadget can enhance, polish up or build on the outfit of an individual through its material, color and ergonomic design. It is a fashion item that makes the carrying process gorgeous and interesting.

Another embodiment of this invention is that it can carry flats, sneakers or the like that the users wear to walk out after they switch to their heels or dress shoes at the occasion. Users can clasp the sneakers securely onto a hook, carabiner or the like and can store or cover them. This embodiment makes the changing process from comfort shoes to heels seamless.

Another embodiment of this invention is when the gadget is not in use, it is small or in a flat form and can be easily stored into bags or other containers without taking up much spaces. It is portable enough to facilitate daily use.

Another embodiment of this invention is that the gadget's attachment can hang the shoes onto any mediums that provide supports, such as hooks or sticks. The goal is to facilitate storage at home or at office.

Another embodiment of this invention is that it minimizes dress shoe damages through encouraging users only wear the dress shoes at the occasion venue as when carrying them is made easier.

It is to be understood that the general description and detailed description are exemplary and not intended to be limiting but instead for further explanation of the disclosed subject matter.

The included drawings, which constitute part of this specification, are provided to illustrate and help further the understanding of the product of the disclosed subject matter.

BRIEF DESCRIPTION OF THE DRAWINGS

A detailed description of various aspects, features, and embodiments of the subject matter described herein is provided with reference to the accompanying drawings, briefly described below. The drawings illustrate various aspects and features of the present subject matter and may illustrate one or more embodiment(s) or example(s) of the present subject matter in whole or part. The drawings are intended to be illustrative, not limiting in nature, are not necessarily drawn to scale, and may exaggerate components to provide clarity.

Like or identical reference numbers are used to identify common or similar elements.

DETAILED DESCRIPTION

Reference will now be made in detail to exemplary embodiments of the disclosed subject matter, this embodiment is illustrated in the provided drawings.

Holding Locations

Figure 1:
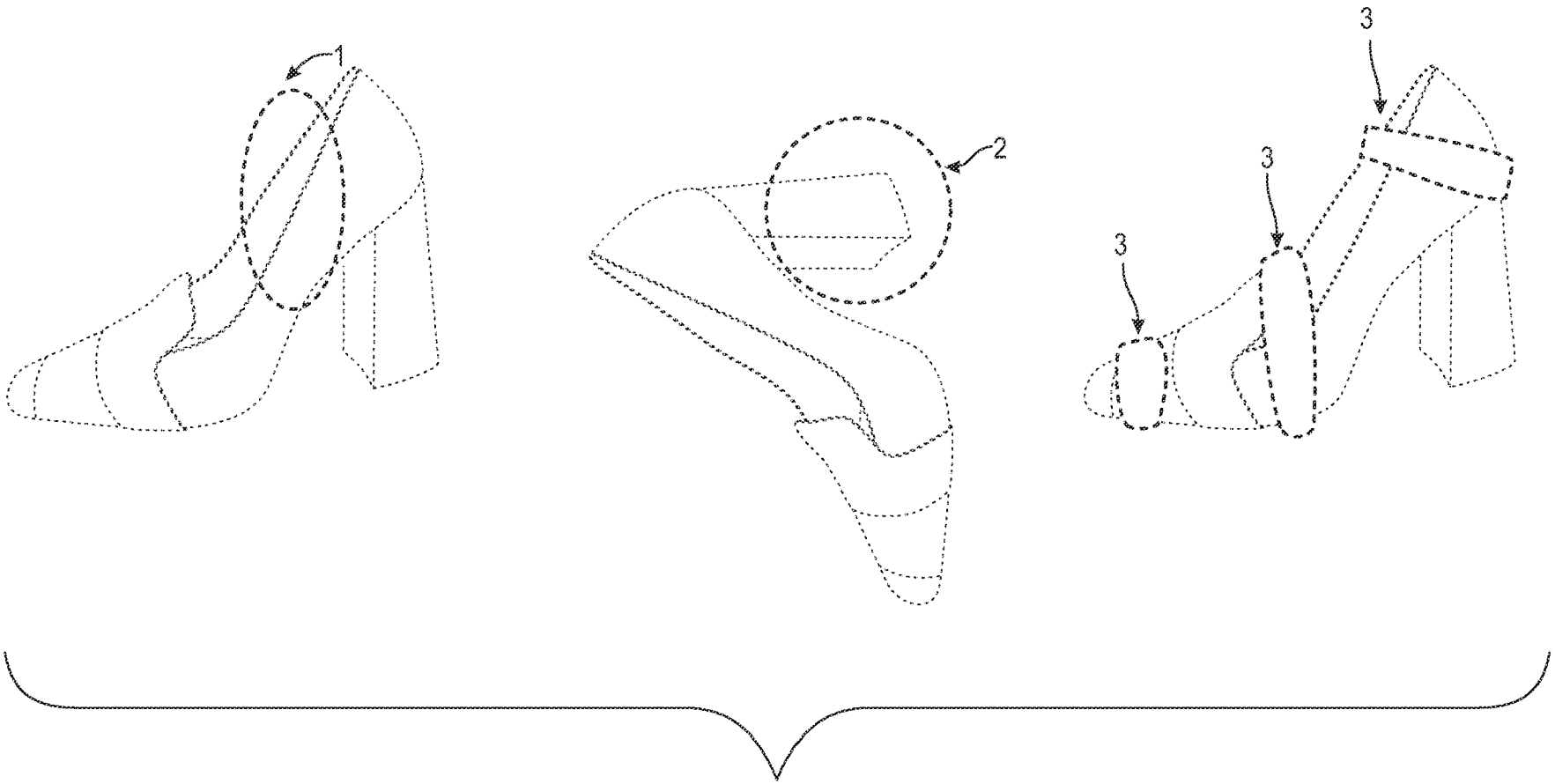
FIG. 1 is a schematic representation indicating the location(s) at which the strapping occurs along the shoe.

The embodiment in FIG. 1 shows where the shoe is held in the embodiments from FIG. 2 to FIG. 6. The grasp can occur at mid-sole region 1, at any points along the heel 2, or evenly along the shoe body with multiple touch points 3.

Holding Via a Strip of Materials

Figure 2:
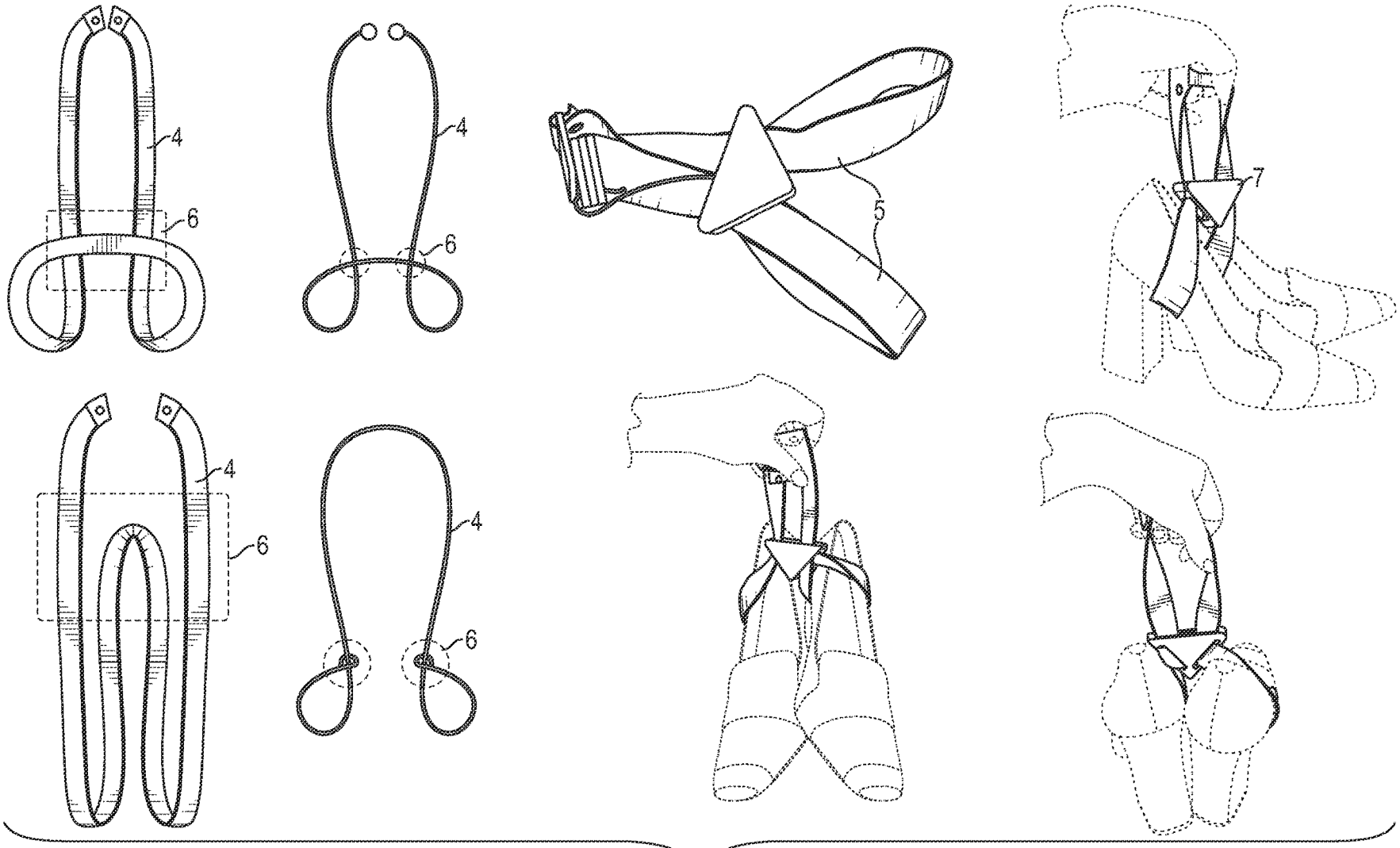
FIG. 2 is a schematic representation of an embodiment in which the continuous strip of material forming a pair of loops.

The embodiment in FIG. 2 functions through holding the shoe with a continuous strip of material 4 that might be made of metal, fabric, leather, plastic or the like. The wiring of the strip forms two loops 5, one loop holds one shoe. The loops can be formed by either winding the strip around itself or using a rig to hold the strip of material in a particular wiring order. While the figure shows five different wiring orders, it is not intended to limit the scope of how the wiring shall be constructed, as long as it can form a pair of loops. The dotted line 6 represents the knot, or the rig, where the length adjustment of the loops shall take place. The rig can be of any sizes, shapes or materials. The friction created from the knot, or the rig, together with the weight of the strapped shoe, makes the grip secured 7. The strapping occurs at either mid-sole region of the shoes, or the heels.

Figure 3:
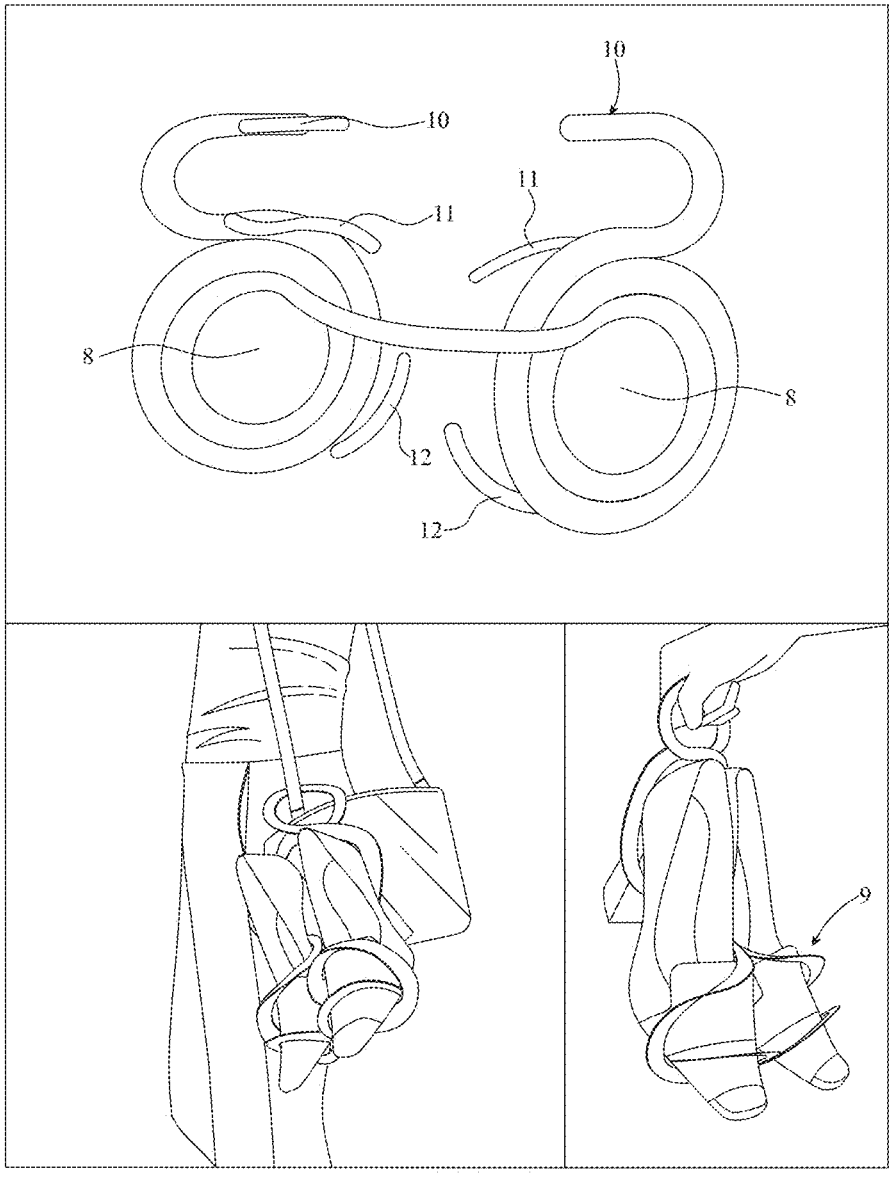
FIG. 3 is a schematic representation of an embodiment with a spiral pattern basic structure.

The embodiment in FIG. 3 functions through holding the shoe with a strip of pliable material. The material can be paper, plastic, wood, metal or the like as long as it is pliable enough to stretch and wrap around the shoes. The length of strand is directly proportional to the size of shoes. The strapping occurs at various points along the shoes to hold the shoe stably. The gadget when not in use is a flat sheet in spiral pattern, with a hole in the middle 8. Upon inserting shoe tips into the hole, the gadget's conformation changes to a 3D structure 9. The pair of structures are held together by velcro or hooks at 10, 11 and 12.

Figure 4:
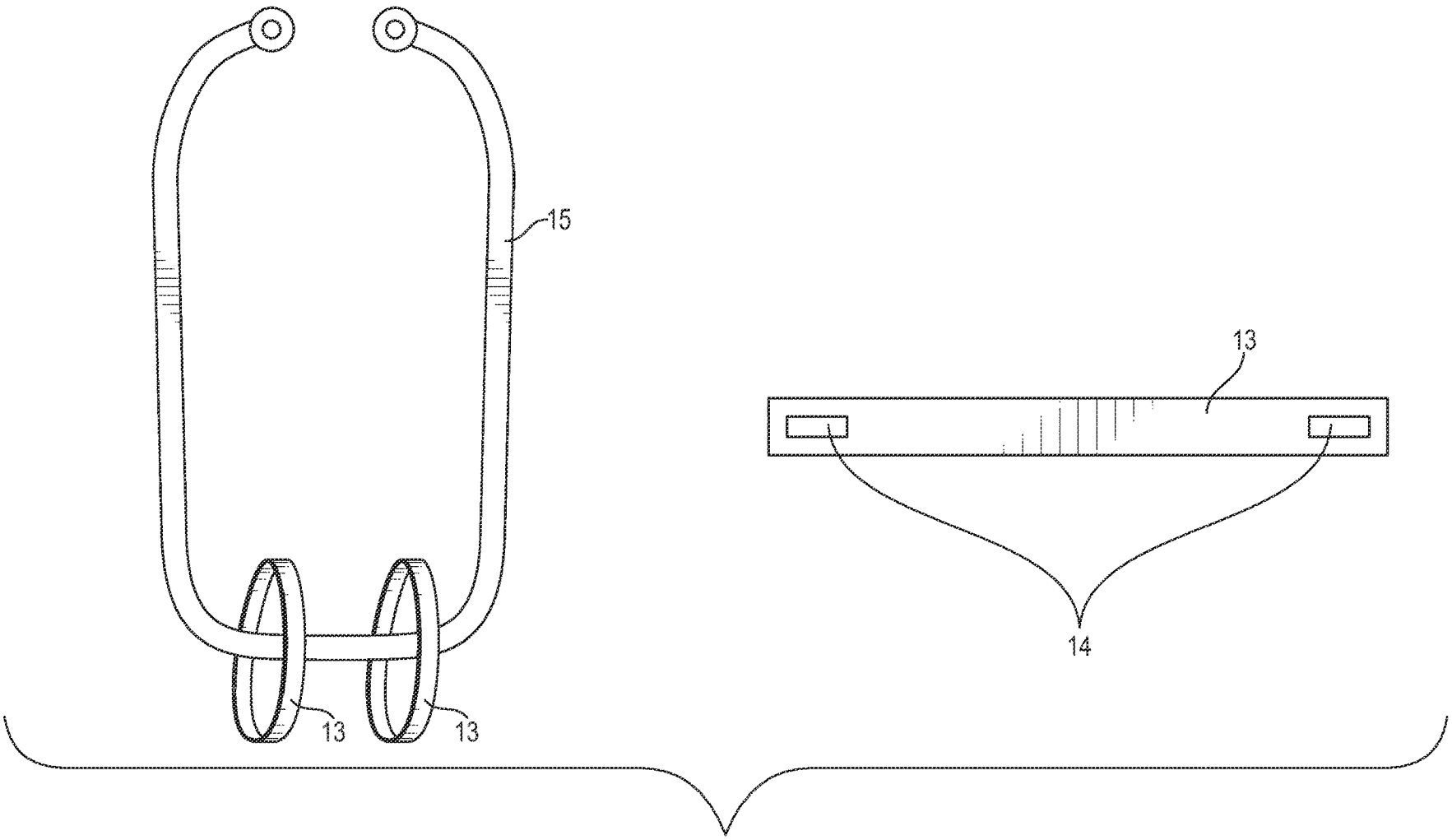
FIG. 4 is a schematic representation of an embodiment with a belt and a plurality of ring bands.

The embodiment in FIG. 4 functions through holding a shoe with a ring band 13. The band can be made of fabric, plastic, wood, metal or the like as long as it is malleable enough to coil around the target object. The ring can be formed by fastening the ends with button, velcro, magnet or the like 14. A belt 15 holds the pair of bands in place by passing through them.

Holding Through an Opening Formed by Materials

Figure 5:
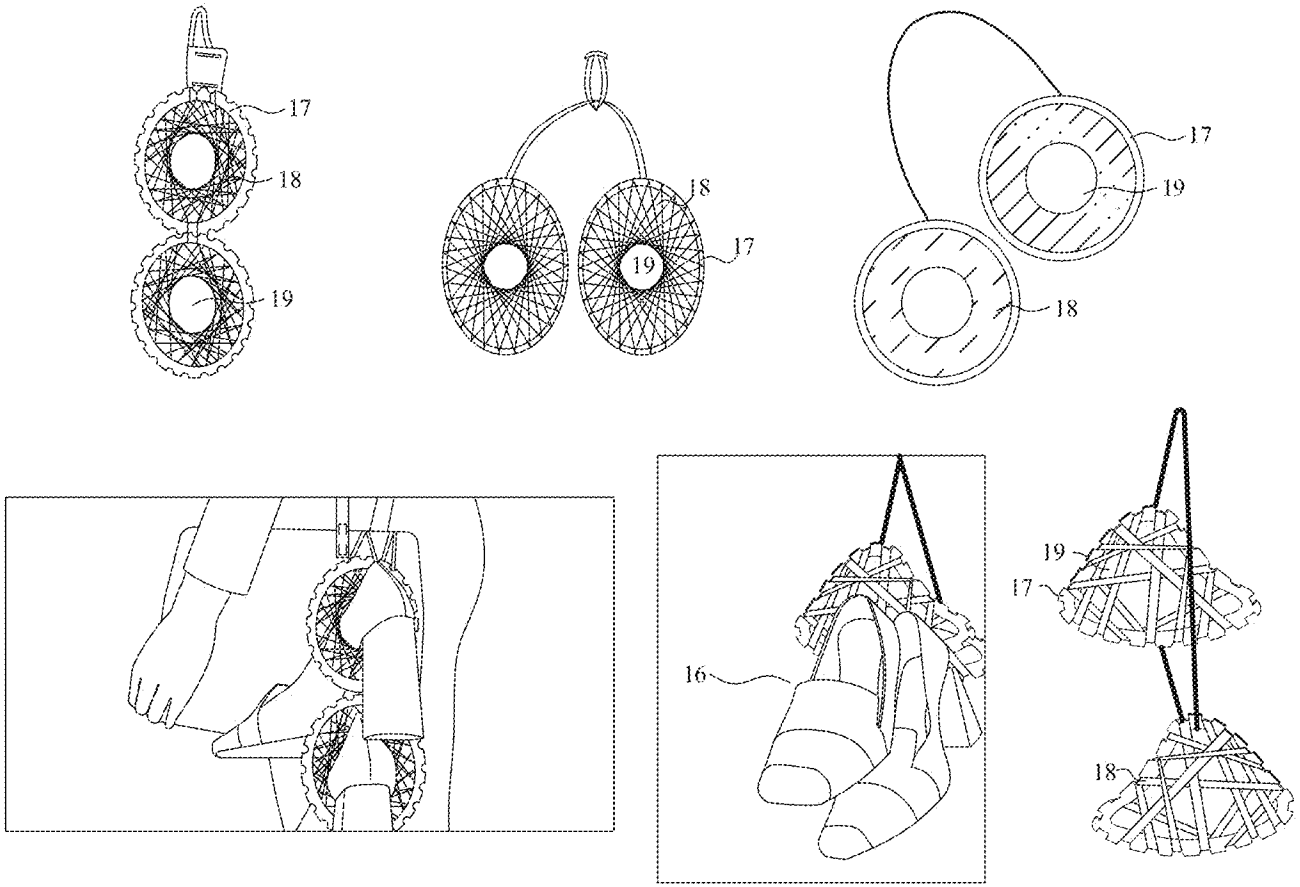
FIG. 5 is a schematic representation of an embodiment with an opening formed by elastic materials.

The embodiment in FIG. 5 functions through holding the shoes 16 at either mid-sole region or the heels with frames 17, each frame holds one shoe 16. The frame 17 can be in any shapes and sizes, with elastic bands or other stretchy materials wrapping around it 18. The elastic bands or materials wrap the frame in such a way that it provides an opening at the center of the frame for shoe insertion 19. The stretchiness of elastic materials allow the gadget to accommodate different sizes of objects.

Figure 6:
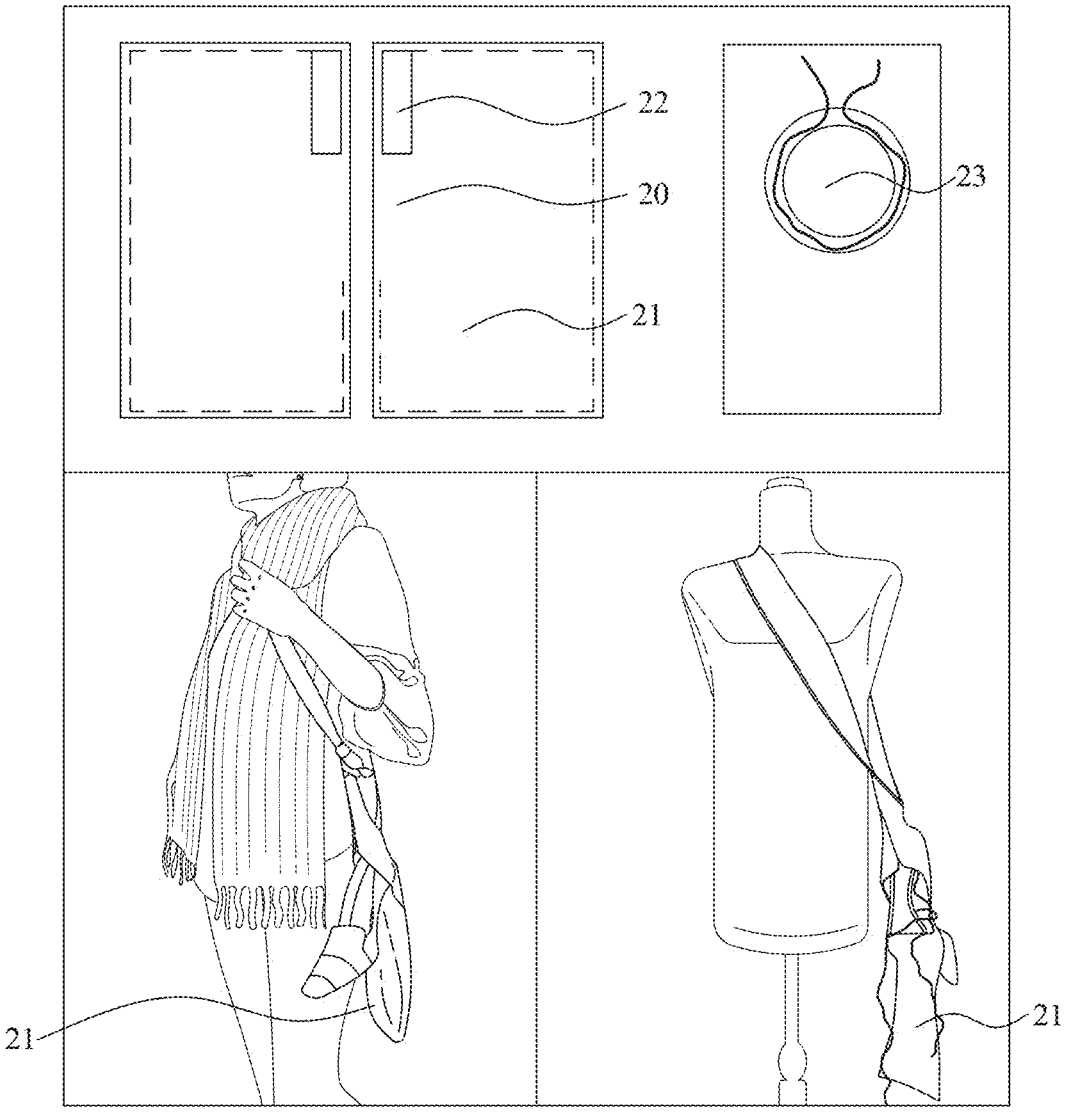
FIG. 6 is a schematic representation of an embodiment with an opening formed by a piece or pieces of cloths.

The embodiment in FIG. 6 functions through holding the mid-sole region of the shoes with an opening in fabric. Through sewing two pieces of fabrics together, an opening 20 and a pouch 21 are formed which the heels can be inserted into. The pouch can also serve to store flats or other comfort shoes. The dashed lines represent the sewing lines. The size of opening can be adjusted through either zipper, buttons, velcro, string or the like 22. Alternatively, the opening can be a cut in the middle of fabric 23.

Attachment to Body and Carrying Style

Figure 7:
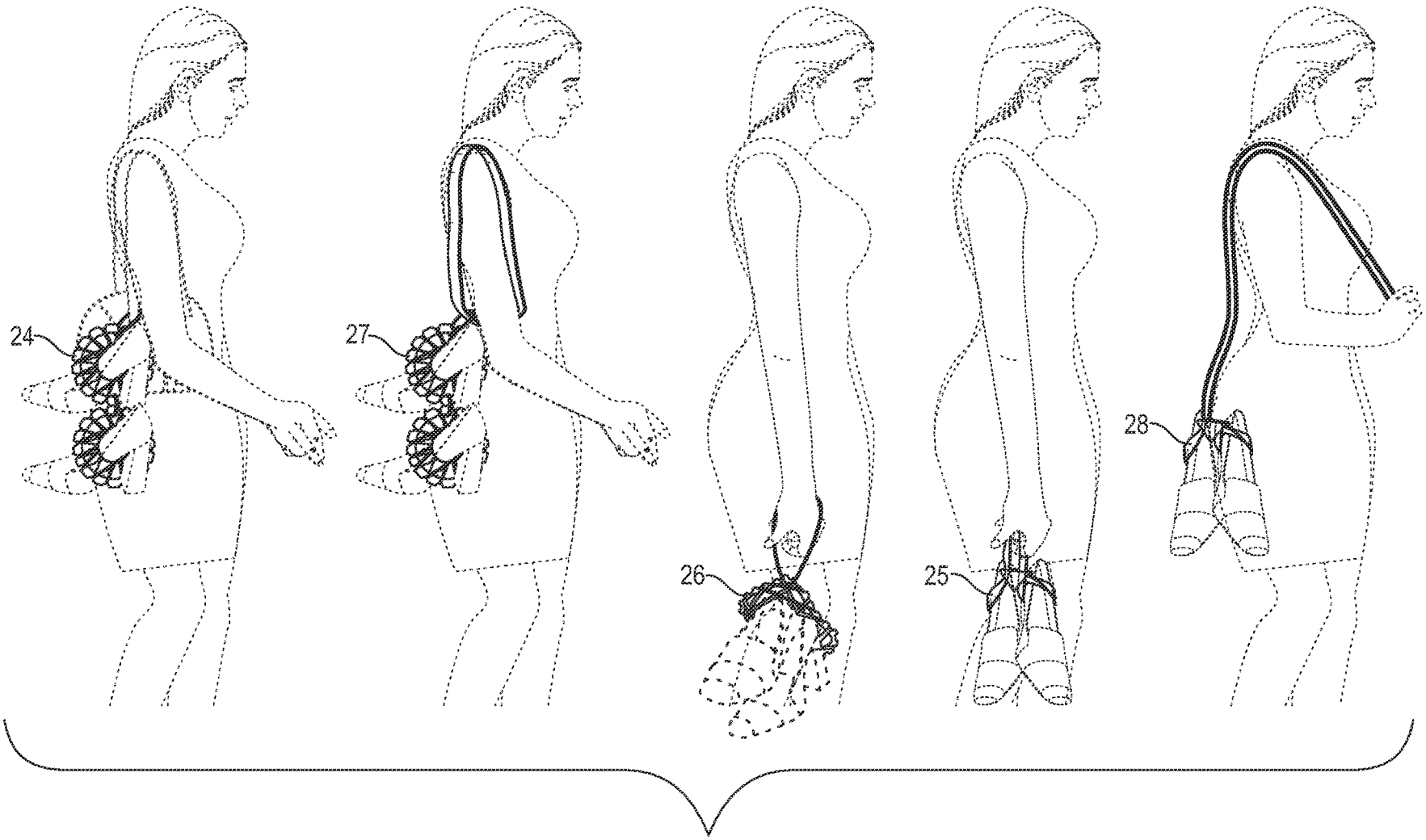
FIG. 7 is a schematic representation of the various mechanisms for carrying the object.

The embodiment in FIG. 7 shows the various ways on how the shoes can be carried, it can be connected to bag/luggages 24, hand held 25, wrist held 26, cross body 27, hung from the shoulder 28 or the like. The embodiments from FIG. 2 to FIG. 6 can be removably fastened to bag, hand strap, wrist strap, shoulder strap or the like through a fastener with magnets, hook, buttons, velcro, zippers, clips or the like.

Adapting Other Accessories

Figure 8:
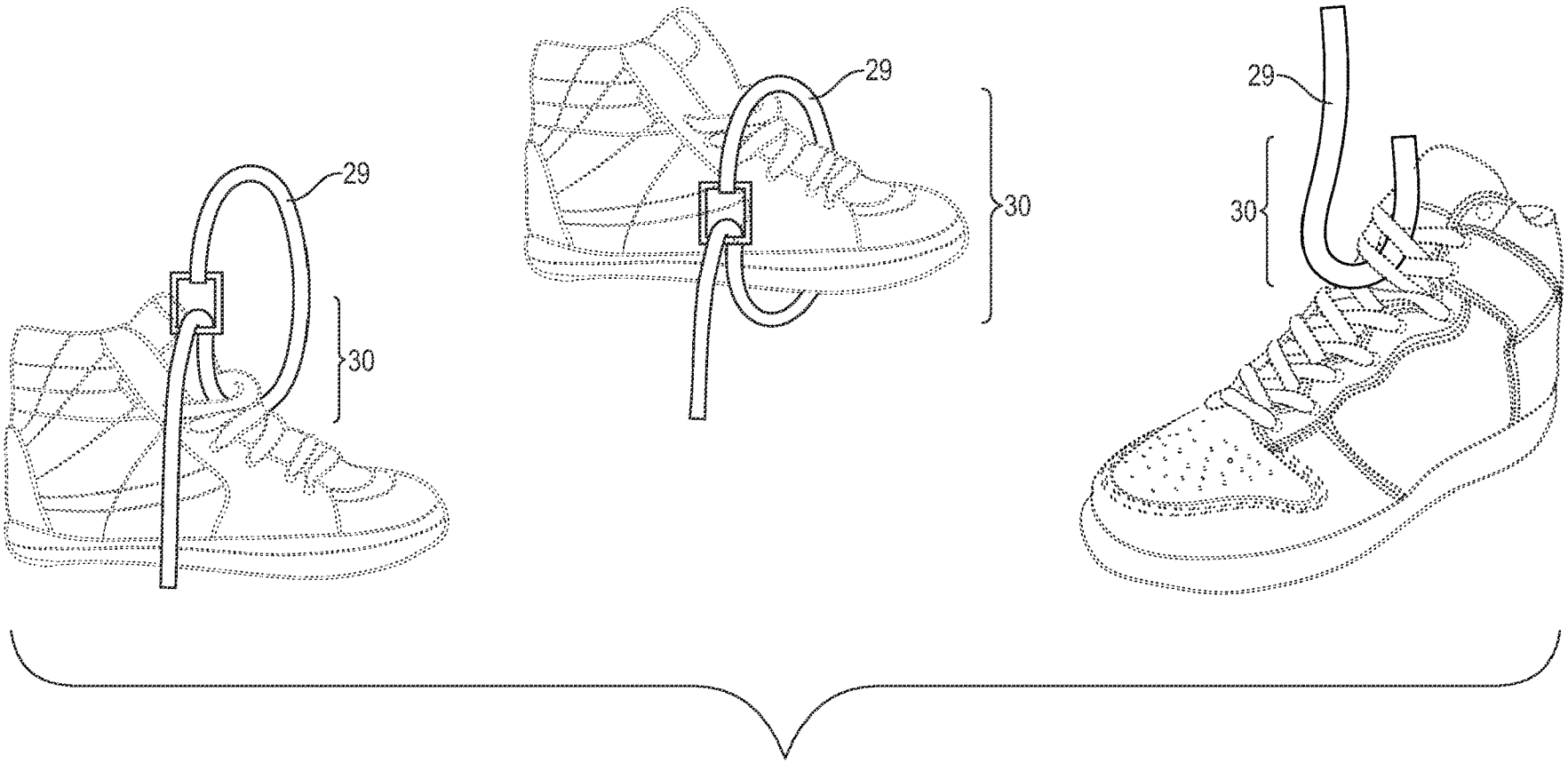
FIG. 8 is a schematic representation of various adaptions based on the object being carried.

FIG. 8 demonstrates that the invention is modular and can adapt other add-on accessories. For example, there can be a carabiner, strand, hook, clips or the like to carry comfort shoes for changing, such as sneakers, flats or slippers. The holding can occur, but not limited to, at, shoelaces, shoe collar or mid-sole region. There can also be a folded pouch or piece of fabric that can be expanded to store or cover up the comfort shoes. The accessories can be attached to anywhere along the strand.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions.

Accordingly, the foregoing description and attached drawings are by way of example only, and are not intended to be limiting.

The invention claimed is:

1. A system for carrying foot apparel, comprising:

a continuous strip of material comprising:

a first portion configured to engage a first shoe of a pair of shoes, wherein the first portion comprises:

a first top section, a first middle section and a first bottom section; and a first hook-and-loop fastener on each of the first top section, the first middle section and the first bottom section; and a second portion configured to engage a second shoe of the pair of shoes, wherein the second portion comprises:

a second top section, a second middle section and a second bottom section; and a second hook-and-loop fastener on each of the second top section, the second middle section and the second bottom section;

wherein:

the first portion of the continuous strip of material is removably attachable to the second portion of the continuous strip of material by using the first hook-and-loop fasteners of the first portion and the second hook-and-loop fasteners of the second portion;

the continuous strip of material has a flat configuration in a spiral pattern before insertion of the pair of shoes therein;

at least each bottom section of the continuous strip of material creates a spiral grip in the form of two loops with each configured to spiral around each shoe of the pair of shoes; and upon insertion of each shoe in the respective loop, the continuous strip of material having the flat configuration changes to a three-dimensional spiral structure.

2. The system for carrying foot apparel of claim 1, further comprising at least one of a bag, a hand strap, a wrist strap, or a shoulder strap of which the continuous strip of material is attached to.

3. The system for carrying foot apparel of claim 2, wherein the bag, hand strap, wrist strap or shoulder strap are attached to the continuous strip of material through one or more magnets, buttons, hook-and-loop fasteners, zippers, buckles, snaps or clips.

4. The system for carrying foot apparel of claim 1, further comprising a strand, a pouch or a piece of fabric, that can be formed by the continuous strip of material, or provided as an add-on member.

5. The system for carrying foot apparel of claim 1, wherein the continuous strip of material is pliable, the material comprising plastic.

6. The system for carrying foot apparel of claim 5, further comprising at least one of a bag, a hand strap, a wrist strap, or a shoulder strap of which the continuous strip of material is attached to.

7. The system for carrying foot apparel of claim 6, wherein the bag, hand strap, wrist strap or shoulder strap are attached to the continuous strip of material through one or more magnets, buttons, hook-and-loop fasteners, buckles, snaps, zippers, or clips.

8. The system for carrying foot apparel of claim 7, further comprising a strand, a pouch or a piece of fabric, that can be formed by the continuous strip of material, or provided as an add-on member.

9. The system for carrying foot apparel of claim 5, further comprising one or more hooks.

10. The system for carrying foot apparel of claim 1, wherein the hook-and-loop fasteners comprise hook-and-loop patches.

11. The system for carrying foot apparel of claim 10, wherein, upon engagement between the first hook-and-loop fasteners of the first portion and the second hook-and-loop fasteners of the second portion, at least each top section of the continuous strip of material creates a handle configured to be held by a user.

12. A method of carrying foot apparel comprising:

(a) providing a system for carrying foot apparel comprising:

a continuous strip of material comprising:

a first portion configured to engage a first shoe of a pair of shoes, wherein the first portion comprises:

a first top section, a first middle section and a first bottom section; and a first hook-and-loop fastener on each of the first top section, the first middle section and the first bottom section; and a second portion configured to engage a second shoe of the pair of shoes, wherein the second portion comprises:

a second top section, a second middle section and a second bottom section; and a second hook-and-loop fastener on each of the second top section, the second middle section and the second bottom section;

wherein:

the first portion of the continuous strip of material is removably attachable to the second portion of the continuous strip of material by using the first hook-and-loop fasteners of the first portion and the second hook-and-loop fasteners of the second portion;

the continuous strip of material has a flat configuration in a spiral pattern before insertion of the pair of shoes therein;

at least each bottom section of the continuous strip of material creates a spiral grip in the form of two loops with each configured to spiral around each shoe of the pair of shoes; and upon insertion of each shoe in the respective loop, the continuous strip of material having the flat configuration changes to a three-dimensional spiral structure; and (b) attaching the top sections to the exterior of a bag, hand strap, wrist strap, or shoulder strap.

13. The method of claim 12, wherein the continuous strip of material is pliable, the material comprising plastic.

14. The method of claim 12, wherein in step (b) the bag, hand strap, wrist strap or shoulder strap are attached to the continuous strip of material through one or more magnets, buttons, hook-and-loop fasteners, zippers, snaps, buckles, or clips.

15. The method of claim 12, wherein the continuous strip of material is further adapted to attach a pouch, a strand or a piece of fabric to surround the foot apparel.

16. The method of claim 12, wherein in step (a) the system for carrying foot apparel has at least one hook.

17. The method of claim 12, wherein the hook-and-loop fasteners comprise hook-and-loop patches.

18. The method of claim 17, wherein, upon engagement between the first hook-and-loop fasteners of the first portion and the second hook-and-loop fasteners of the second portion, at least each top section of the continuous strip of material creates a handle configured to be held by a user.

* * * * *